US008307920B2

(12) United States Patent
Buske et al.

(10) Patent No.: US 8,307,920 B2
(45) Date of Patent: Nov. 13, 2012

(54) ROLLER CONE DISK WITH SHAPED COMPACTS

(75) Inventors: Robert J. Buske, The Woodlands, TX (US); James L. Overstreet, Tomball, TX (US); Thomas M. Stefanik, Conroe, TX (US); Shyam Anandampillai, Spring, TX (US); Robert D. Bradshaw, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 448 days.

(21) Appl. No.: 12/541,048

(22) Filed: Aug. 13, 2009

(65) Prior Publication Data

US 2011/0036639 A1 Feb. 17, 2011

(51) Int. Cl.
*E21B 10/16* (2006.01)

(52) U.S. Cl. ..... 175/373; 175/331

(58) Field of Classification Search ..... 175/374, 175/331, 373

See application file for complete search history.

(56) References Cited

U.S. PATENT DOCUMENTS

| | | | | | |
|---|---|---|---|---|---|
| 2,939,684 | A * | 6/1960 | Payne | 175/375 |
| 3,358,782 | A * | 12/1967 | Bechem | 175/344 |
| 3,397,751 | A * | 8/1968 | Reichmuth | 175/341 |
| 3,679,009 | A * | 7/1972 | Goodfellow | 175/374 |
| 3,734,213 | A * | 5/1973 | Goodfellow | 175/374 |
| 3,786,879 | A * | 1/1974 | Murdoch | 175/374 |
| 3,791,465 | A * | 2/1974 | Metge | 175/373 |
| 4,136,748 | A | 1/1979 | Dickerhoff | |
| 5,311,958 | A | 5/1994 | Isbell et al. | |
| 5,341,890 | A * | 8/1994 | Cawthorne et al. | 175/374 |
| 5,452,771 | A * | 9/1995 | Blackman et al. | 175/353 |
| 5,644,956 | A * | 7/1997 | Blackman et al. | 76/108.2 |
| 5,904,211 | A * | 5/1999 | Friant et al. | 175/228 |
| 6,343,842 | B1 * | 2/2002 | Sauer et al. | 299/79.1 |
| 6,564,884 | B2 * | 5/2003 | Bird | 175/57 |
| 6,640,913 | B2 | 11/2003 | Portwood et al. | |
| 6,766,870 | B2 * | 7/2004 | Overstreet | 175/374 |
| 6,823,951 | B2 * | 11/2004 | Yong et al. | 175/331 |
| 7,025,155 | B1 | 4/2006 | Estes | |
| 7,066,288 | B2 | 6/2006 | Van Klompenburg et al. | |
| 7,096,981 | B2 | 8/2006 | Van Klompenburg et al. | |
| 7,240,746 | B2 * | 7/2007 | Overstreet et al. | 175/374 |
| 7,331,410 | B2 * | 2/2008 | Yong et al. | 175/331 |
| 7,367,413 | B2 | 5/2008 | Lockstedt et al. | |

OTHER PUBLICATIONS

Choi, Jeong Sik, Korean Intellectual Property Office, PCT International Search Report, Mar. 30, 2011.

* cited by examiner

*Primary Examiner* — Daniel P Stephenson
(74) *Attorney, Agent, or Firm* — Bracewell & Giuliani LLP

(57) ABSTRACT

An earth boring drill bit that includes a cutting cone with a cutting disk. Compacts are inserted within the disk having a chisel shaped end set flush with the cutting disk periphery. The compact crests and cutting disk periphery form a generally seamless cutting surface. The cutting cone can further include cutting teeth thereon also having flush mounted compacts. The compacts can be made from a material such as cemented carbide, hardfacing, tungsten, tungsten alloys, tungsten carbide and the cutter made from steel.

11 Claims, 6 Drawing Sheets

ROLLER CONE DISK WITH SHAPED COMPACTS

BACKGROUND

1. Field of Invention

The disclosure herein relates in general to rolling cone earth boring bits and in particular to improving the performance of a roller cone bit.

2. Description of Prior Art

Drilling systems having earth boring drill bits are used in the oil and gas industry for creating wells drilled into hydrocarbon bearing substrata. Drilling systems typically comprise a drilling rig (not shown) used in conjunction with a rotating drill string wherein the drill bit is disposed on the terminal end of the drill string and used for boring through the subterranean formation.

Drill bits typically are chosen from one of two types, either drag bits or roller cone bits. Rotating the bit body with the cutting elements on the outer surface of the roller cone body crushes the rock and the cuttings may be washed away with drilling fluid. One example of a prior art roller cone bit 11 is provided in a side partial perspective view in FIG. 1, the bit 11 having a body 13 with a threaded attachment 15 on the bit 11 upper end for connection to a drill string (not shown). The bit 11 further includes legs 18 extending downward from the bit body 13. Each bit leg 18 is shown having a lubrication compensator 17.

The bit body 13 is further illustrating having a nozzle 19 for directing pressurized drilling fluid from within the drill string to cool and clean bit 11 during drilling operation. A plurality of cutter cones 21 are rotatably secured to respective bit legs 18. Typically, each bit 11 has three cutter cones 21, and one of the three cutter cones is obscured from view in FIG. 1.

Each cutter cone 21 has a shell surface including a gage surface 25 and a heel region indicated generally at 27. Teeth 29 are formed in heel region 27 and form a heel row 28 of teeth. The heel teeth 29 depicted are of generally conventional design, each having leading and trailing flanks 31, 32 that converge to a crest 33. Each tooth 29 has an inner end (not shown) and an outer end 35 that joins to crest 33.

Typically steel tooth bits are for penetration into relatively soft geological formations of the earth. The strength and fracture toughness of the steel teeth permits the use of relatively long teeth, which enables the aggressive gouging and scraping actions that are advantageous for rapid penetration of soft formations with low compressive strengths. However, geological formations often comprise streaks of hard, abrasive materials that a steel-tooth bit should penetrate economically without damage to the bit. Although steel teeth possess good strength, abrasion resistance is inadequate to permit continued rapid penetration of hard or abrasive streaks.

A layer of wear-resistant "hardfacing" material (not shown) may be applied on portions of roller cone bits 11, including the body 13, legs 18, cutter cones 21, and teeth 29. Hardfacing typically consists of extremely hard particles, such as sintered, cast, or macrocrystalline tungsten carbide, dispersed in a steel matrix. Typical hardfacing deposits are welded over a steel tooth that has been machined similar to the desired final shape. Generally, the hardfacing materials do not have a tendency to heat crack during service which helps counteract the occurrence of frictional heat cracks associated with carbide inserts. The hardfacing resists wear better than the steel cone material, therefore the hardfacing on the surface of steel teeth makes the teeth more resistant to wear.

A front view of a prior art cutter cone 21 is illustrated in FIG. 2. Shown formed on the cutter cone 21 is an inner row 36 having inner row teeth 37 extending radially inward from the heel 27 (see FIG. 1). The inner row teeth 37 have flanks and crests similar to the flanks 31, 32 and crests 33 of the heel teeth 29. An apex 38 is shown proximate to the cutter cone 21 center, the apex 38 having grooves radially extending from the apex 38 midpoint to its outer periphery. A layer of hardfacing 39 is shown having been applied to surfaces of the heel teeth 29 and the inner row teeth 37. The span between oppositely facing leading 32 and trailing flanks 31 can be filled with hardfacing to form a disk shaped cutting row on the cutter cone 21.

SUMMARY OF INVENTION

Disclosed herein is an earth boring drill bit having a body, a leg depending from the body, a bearing shaft extending radially inward from the leg, a cutting cone mounted on the bearing shaft, a cutting disk on the cutting cone, and compacts set flush within the cutting disk. The earth boring bit may include a cutting surface defined by a path on the cutting disk surface where the crests of the compacts are arranged. The cutting disk, in an example, has an upper surface, a lower surface, and an outer edge that extends between the upper and lower surfaces, and wherein the compacts are arranged so that their crests are aligned with the outer edge to thereby define a cutting surface along the outer edge and the crests of the compacts. The upper and lower surfaces may be angled towards one another proximate to the outer edge and wherein the compacts include profiled surfaces depending downward from the crests, so that when the compacts are disposed in the cutting disk, the profiled surfaces are coplanar with the upper and lower surfaces. The cutting disk can be coaxially disposed on the cutting cone. The compacts can be formed from cemented carbide.

Optionally, the earth boring bit can further include serrations provided on the cutting disk outer edge. In another alternative, the serrations are provided between adjacent compacts. Teeth may be included on the cutting cone having compacts flush within the teeth. Each compact may include a chisel shaped tip on an axis and a cylindrically shaped body about an axis that is angled with respect to the axis of the chisel wherein adjacent compacts are rotated so their respective bodies are spaced apart in the cutting disk. The ratio of compact material hardness to cutter material hardness can, in one example be about 1.2:1, about 1.8:1, about 2:1, about 3:1, or about 3.3:1.

Also disclosed herein is a method of forming an earth boring bit. In one example the method includes providing a bit that has a body, a leg depending from the body, a bearing shaft extending radially inward from the leg, a cutting cone mounted on the bearing shaft, a cutting surface on the cutting cone, and bores extending from the cutting surface into the cutting cone. The method of this example can further include providing compacts with an elongated body portion, a chisel shaped tip on an end of the body portion, and coupling each compact within one of the bores and arranging the compacts so that each tip is substantially flush with the cutting surface. Each compact of the method can be formed from cemented carbide. Coupling be applying a press fit between the compact and the bore or brazing the compacts in the bore. The tip and body of each compact may be canted with respect to one another and wherein adjacent bores in the cutting cone project along non-parallel paths so that the respective bodies of adjacent compacts are disposed in non-interfering positions.

The cutting cone of the method can further include teeth arranged on the cutting cone having bores formed into the teeth, and the method can further involve coupling compacts flush into the bores in the teeth. Counterbores can be provided in the cutting disk prior to creating bores therein where the counterbores are covered during a step of heat treating the bit. The compacts can have an optional diamond covering.

BRIEF DESCRIPTION OF DRAWINGS

Some of the features and benefits of the present invention having been stated, others will become apparent as the description proceeds when taken in conjunction with the accompanying drawings, in which.

Figure 1:
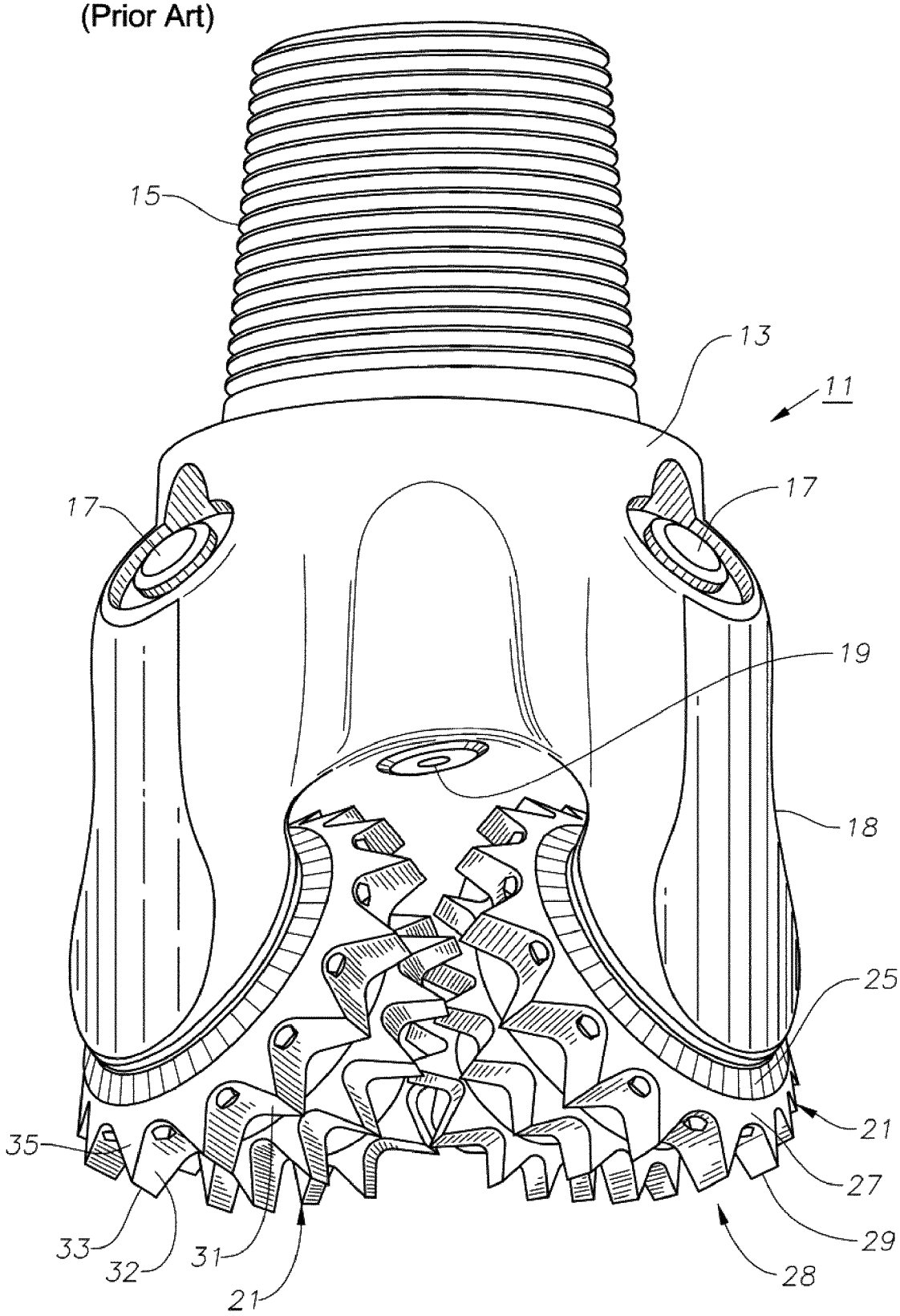
Fig. 1 (Prior Art)
FIG. 1 is a side perspective view of a prior art roller cone bit.
Figure 2:
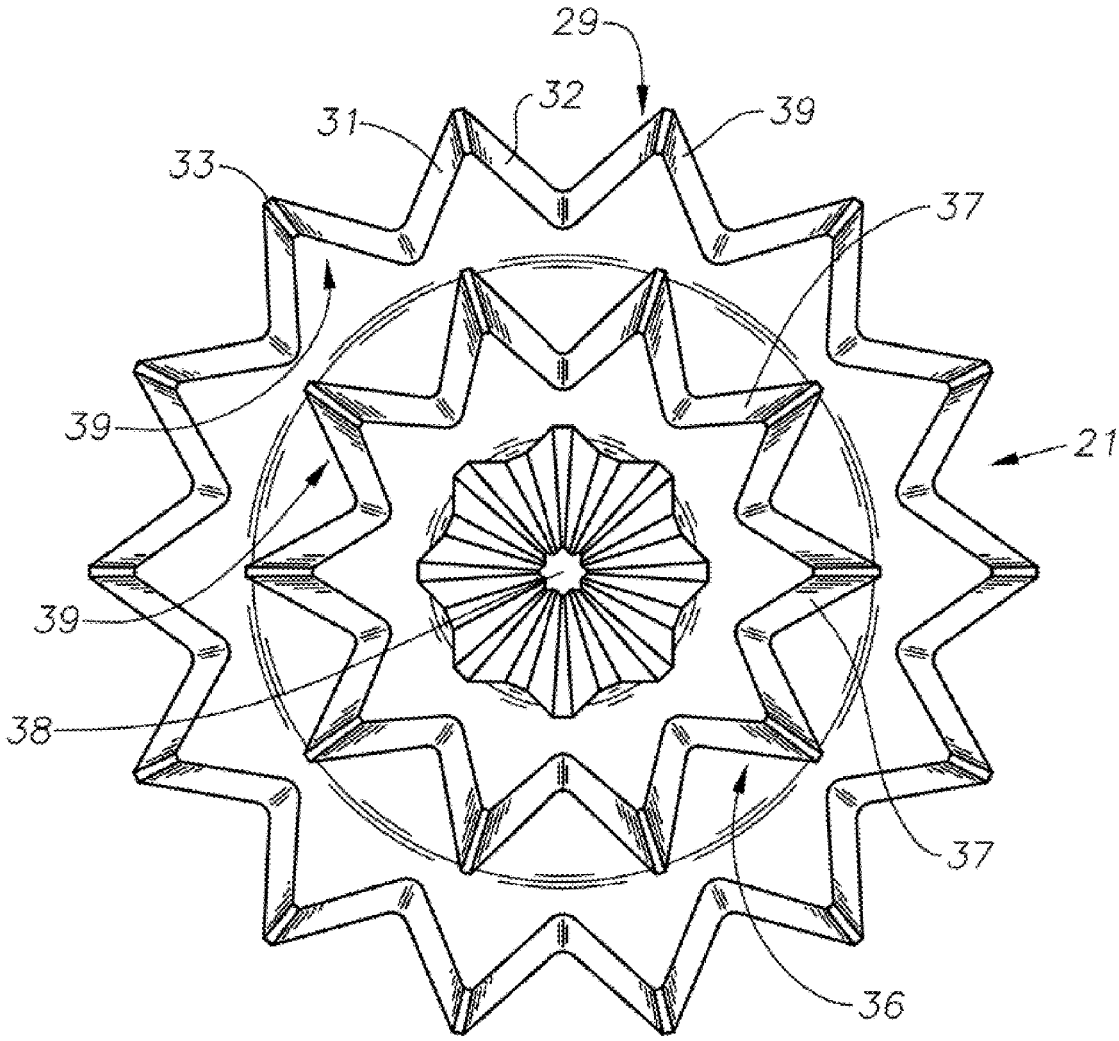
Fig. 2 (Prior Art)
FIG. 2 depicts a bottom view of a prior art milled steel tooth cutting cone.

While the subject device and method will be described in connection with the preferred embodiments but not limited thereto. On the contrary, it is intended to cover all alternatives, modifications, and equivalents, as may be included within the spirit and scope of the present disclosure as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be through and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Figure 3:
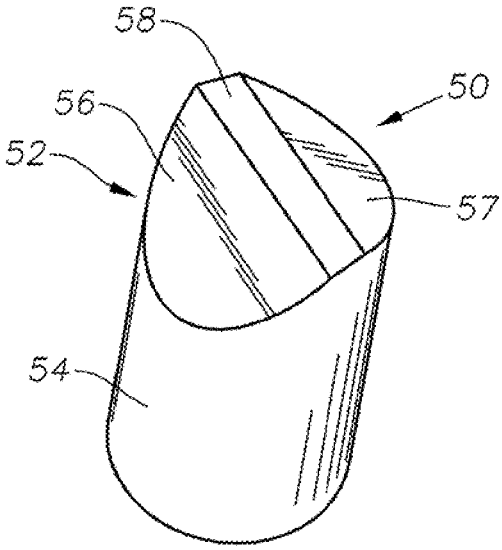
FIG. 3 depicts in a perspective view an example of a compact for use in an earth boring bit.

Shown in a side perspective view in FIG. 3 is an example of a compact 50; also alternatively referred to herein as an insert. In an example, the compact 50 is formed from cemented carbide. The compacts 50 may have a Rockwell "A" hardness ranging from about 83 up to about 95. The compact 50 of FIG. 3 is shown having a chisel-shaped tip 52 and a substantially cylindrical barrel 54 depending downward from the tip 52. As shown, the tip 52 includes a recumbent crest 58 on its upper terminal edge with downwardly depending planar surfaces or flanks 56, 57 formed along opposite lateral sides of the crest 58 terminating at the upper end of the barrel 54. Flanks 56, 57 incline at different angles relative to the axis of barrel 54. Flanks 56, 57 are on inner and outer sides of compact 50, not leading and trailing sides. Crest 58 and flanks 56, 67 may be substantially flat surfaces or they may be curved slightly.

Figure 3A:
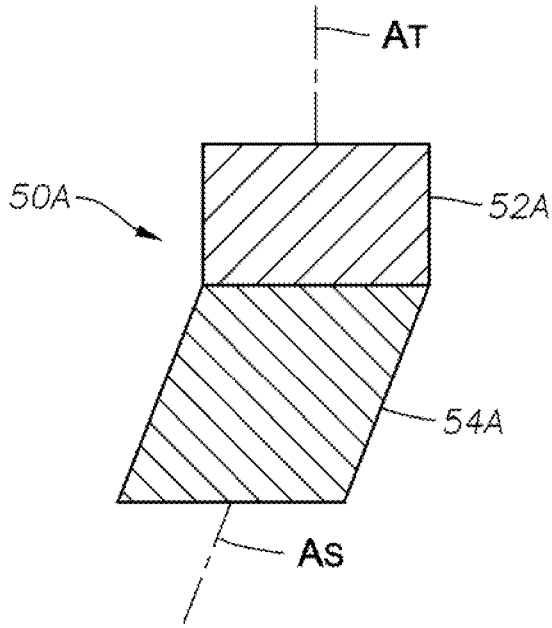
FIG. 3A illustrates a side sectional view of an alternative compact for use in an earth boring bit.

In FIG. 3A, an alternative embodiment of a compact 50A is shown in a side view. In this embodiment, the tip 52A is canted with respect to the barrel 54A. The compact 50A is canted by setting the barrel 54A around an axis $A_S$ and setting the tip 52A around a corresponding axis $A_T$; wherein the axes $A_S$ and $A_T$ are at an angle with respect to each other. As will be described in more detail below, providing canted compacts 50A can avoid interference between adjacently disposed compacts 50A.

Figure 4:
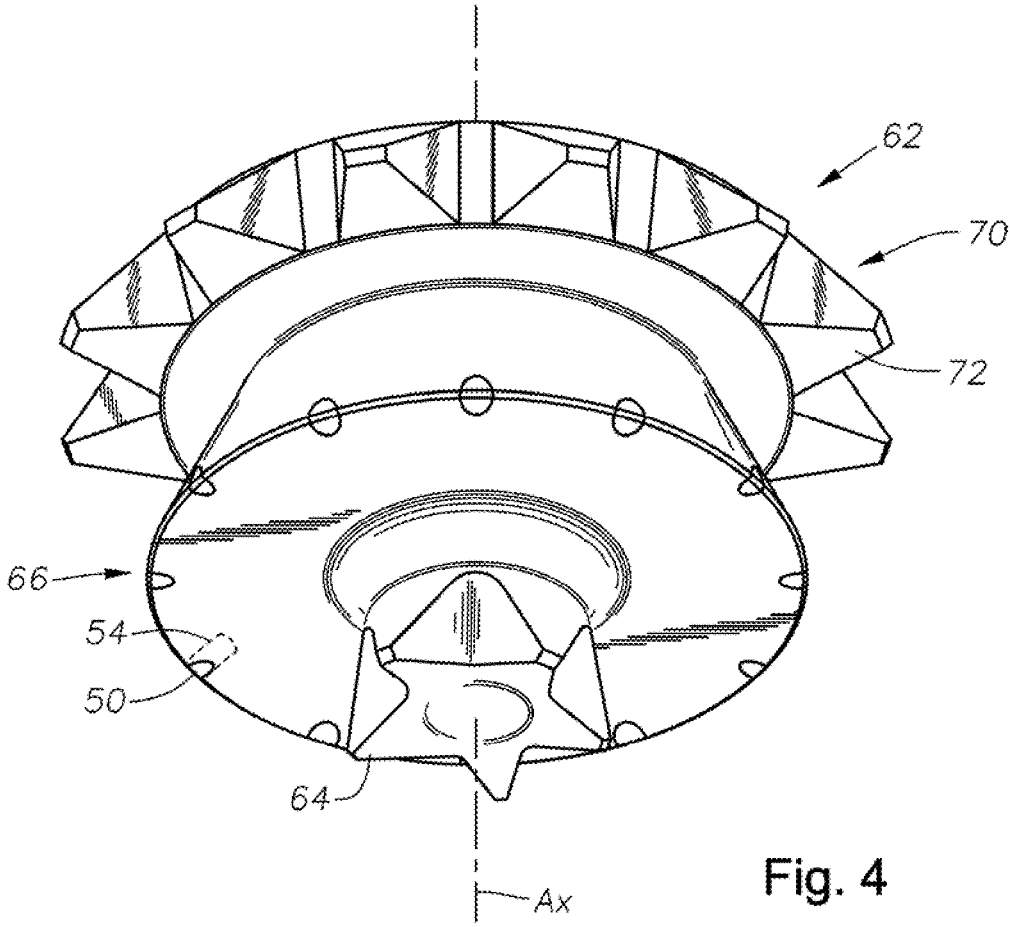
FIG. 4 portrays an example of a cone of a roller cone having compacts flush within a disk row.

An example of a cutting cone 62 in accordance with the present disclosure is provided in perspective view in FIG. 4. In this example, the cutting cone 62 includes an apex or nose 64 on its uppermost surface having cutting elements on its upper surface that coaxially circumscribe the axis $A_x$ of the cutting cone 62. Also coaxial with the cone axis $A_x$ is an inner row or disk 66 shown on the cutting cone 62 that is generally smooth along its periphery. Included within the inner row 66 are compacts 50; their respective barrels 54 are directed radially inward towards the cone axis $A_x$ from the peripheral edge of the cutting cone 62. The cutting cone 62 also includes an outer row 70 coaxial with the cone axis $A_x$ and disposed on a side of the inner row 66 opposite the apex 64. The outer row 70 includes a series of teeth 72 arranged around the cutting cone 62 forming a cutting surface. An example of cutting cone 62 material includes steel having a Rockwell C hardness from about 40 to about 54.

Figure 5:
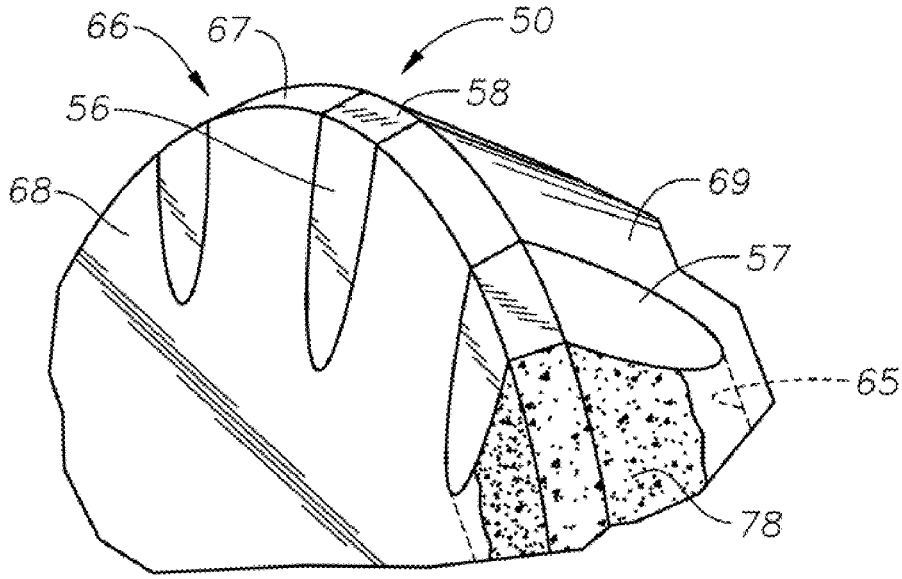
FIG. 5 illustrates in an enlarged side perspective view, a portion of the cone of FIG. 4.

FIG. 5 is an enlarged side perspective view of a portion of the disk or inner row 66 of FIG. 4. The inner row 66 includes an inner surface 68 facing the apex 64 (FIG. 4) and intersected by the cone axis $A_x$. Inner surface 68 is a continuous conical surface, but it could be a substantially flat surface perpendicular to axis $A_x$. The inner row 66 further includes an outer surface 69 forming an opposite side of the inner row 66. Outer surface 69 is shown as a continuous conical surface at a greater angle relative to cone axis $A_x$ than inner surface 68. In one embodiment, the outer surface 69 could be a substantially flat surface perpendicular to axis $A_x$. The row circular ridge or peripheral edge 67 defines the row 66 periphery and connects between the inner and outer surfaces 68, 69 on their respective terminal ends. In this view, the compacts 50 are shown flush-mounted within the inner row 66 so that the flanks 56, 57 on each compact 50 coincide with the inner and outer surfaces 68, 69 of the inner row 66. This orients the flank 56 of the compact 50 substantially flush with the inner surface 68 of the inner row 66 and the flank 57 of each compact 50 coplanar and aligned with the outer surface 69 of the inner row 66. Additionally, the crest 58 of each compact 50 is set so that it is substantially seamless with the inner row peripheral edge 67. The peripheral edge 67 and compact crests 58 combine to form a disk-shaped cutting surface with a continuous circular periphery. If flanks 56, 57 and crest 58 are substantially flat, they will not be quite flush with inner and outer surfaces 68, 69 and peripheral edge 67 because these surfaces are curved in conical and circular shapes. Flanks 56, 57 and crest 58 could be curved to be precisely flush, if desired. Optional hardfacing 78 is shown on the outer edge 67 and upper and lower surfaces 68, 69 of the inner row 66. The hardfacing 78 can be applied on all other surfaces of the cone 62 and may be flush with or project above the compacts 50.

One of the advantages of the embodiment shown herein is the hardened composition of the compacts 50 resist wear longer than the typical ferrous materials used as a base material of the inner row 66. Accordingly, the compacts 50 will experience less erosion during use than the inner row 66 and provide a cutting function for a longer period of time. Moreover, it is expected that the portion of the inner row 66 adjacent the trailing edge of each compact crest 58 will experience less erosion than the portion of the peripheral edge 67 proximate the compact leading edge. The presence of this portion of the peripheral edge at the trailing edge portion of each compact 50 supports the compacts 50 within the respective bores 65 formed within the inner row 66. The compacts 50 may be coupled with the inner row 66 by a press or interference fit technique. Optionally, the compacts 50 may be brazed within the bores 65. Hardfacing may be applied over the inner row 66, outer edge 67, upper surface 68, and/or lower surface 69.

In an optional method of forming the cutting cone 62 of FIG. 4; the bores 65 are not formed along a line normal with the circular peripheral edge 67. Instead adjacent bores 65 may alternatingly be angled inward towards the apex 64 or outward toward the outer row 70. Thus when the compacts 50 are set in the adjacent bores 65 the risk of interference within the body of the cutting cone 62 is eliminated. In one example of use, when the canted compacts 50A of FIG. 3A are set in adjacent bores they may be rotated 180° with respect to one another. The respective angled barrels 54A of adjacent compacts 50A are offset in opposite directions along the axis $A_x$ and not in an interfering arrangement. The canted configuration allows the tip 52A of each compact 50A to be positioned flush with the outer periphery of the cutting disk 66 of the cutting cone 62.

Figure 6:
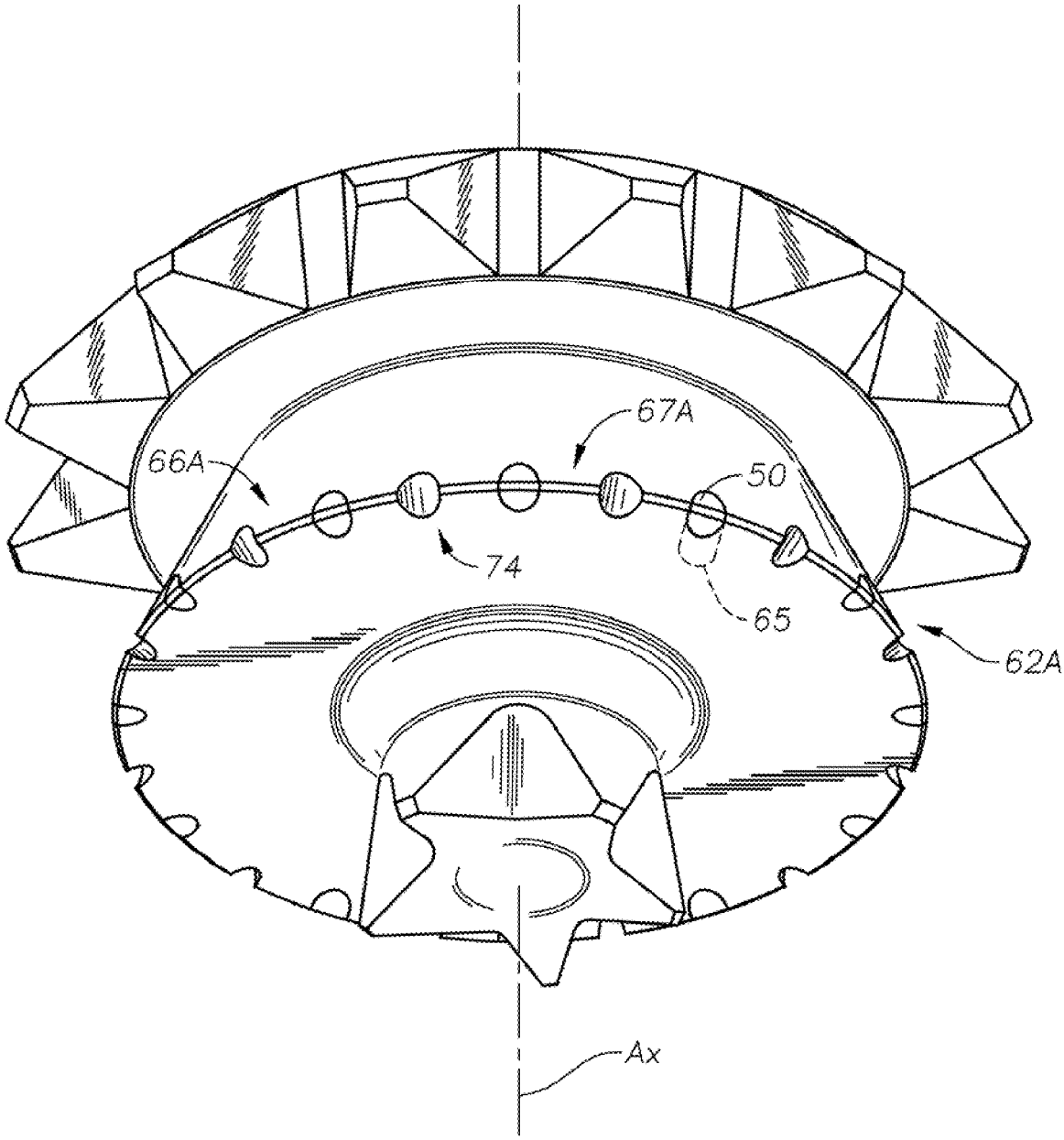
FIG. 6 depicts in side perspective view an example of a roller cone with flush compacts and serrations on a disk row.
Figure 7:
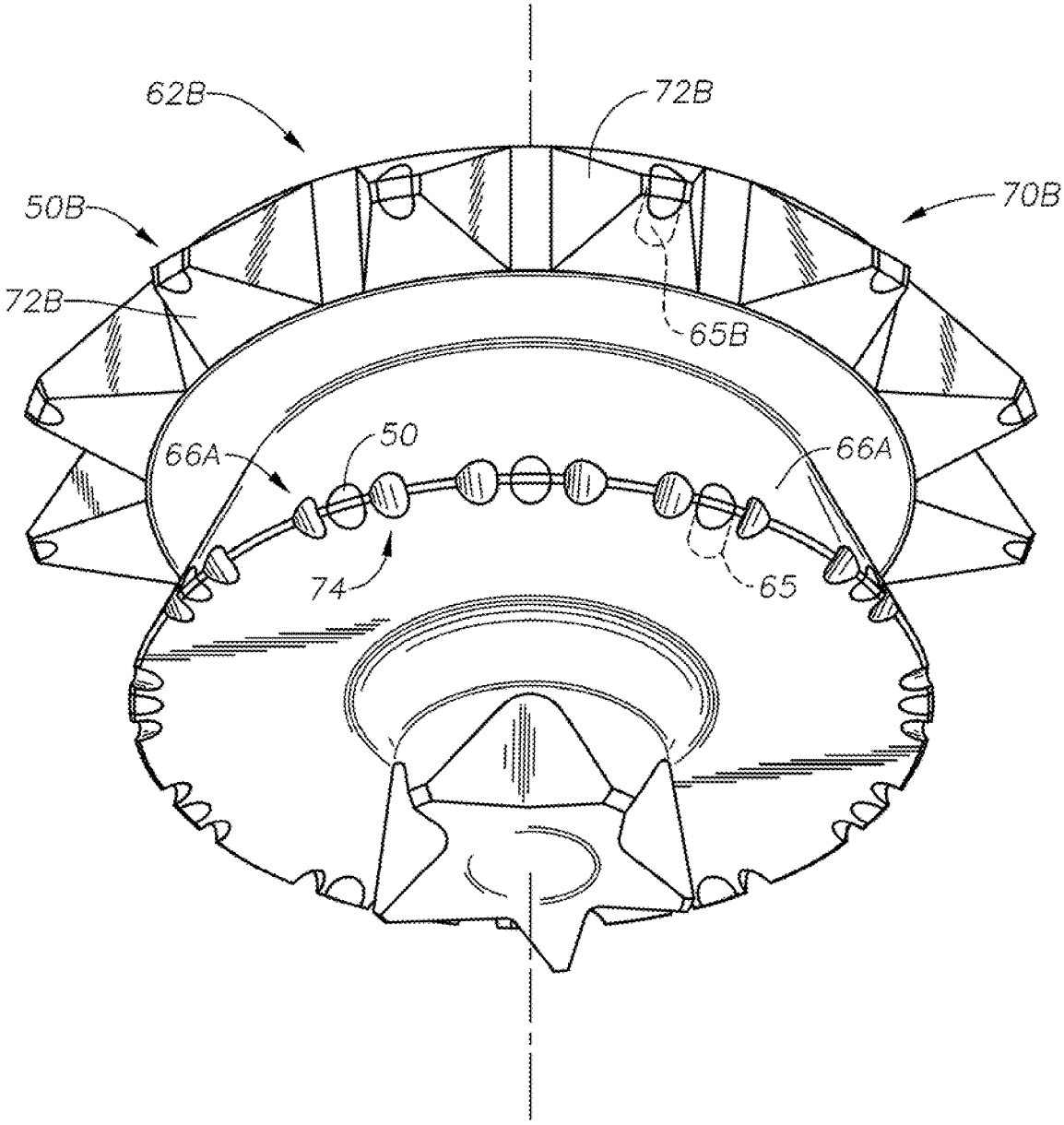
FIG. 7 provides in a perspective view an example of a roller cone with compacts flush within cutting teeth.

An alternate embodiment of the present device is illustrated in a side perspective view in FIG. 6. In this embodiment, a cutting cone 62A is shown having an inner row 66A with bores formed therein that project radially towards the cone axis and having compacts 50 provided in the bores 65. In this embodiment, serrations 74 are formed along the inner row 66A peripheral edge 67A and between adjacent compacts 50. Removing material between adjacent compacts 50 can enhance boring operations by maximizing contact between the harder compacts 50 and the formation. The circumferential extent of each serration 74 is preferably less than the circumferential distance between adjacent compacts. Each crest of each compact 50 is thus flush with a portion of peripheral edge 67A. Serrations 74 are illustrated as being curved, partially circular recesses, Referring now to FIG. 7, an alternative embodiment of a cutting cone 62B is shown in a perspective view. The cutting cone 62B of FIG. 7 includes an inner row 66A with compacts 50 in bores 65, and serrations 74 between the compacts 50. The cutting cone 62B farther includes an outer row 70B of teeth 72B, the teeth 72B having bores 65B formed therein. The bores 65B, shown in dashed outline, extend towards the cone axis (not shown) from the crest of each tooth 72B. Set within the bores 65B, the crests of compacts 50B are shown flush with the upper terminal portion or crest of each tooth 72B. The inner and outer flanks of compacts 50B are illustrated flush with the inner and outer sides of each tooth 72B. The presence of the hard material compacts 50B provides added wear resistance to an inner core of each tooth 72B, thereby increasing their useful life.

Figure 8:
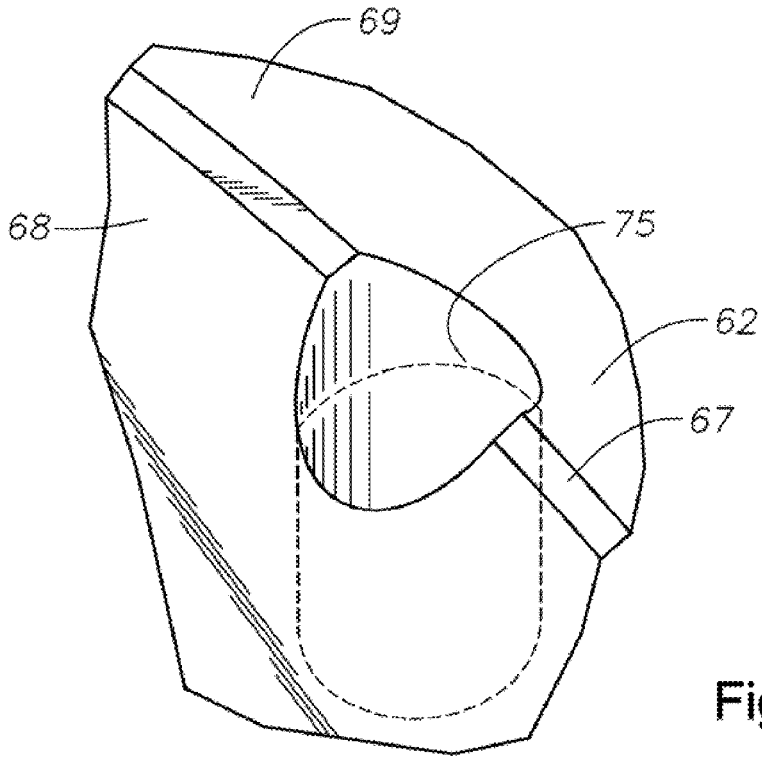
FIG. 8 illustrates in perspective view an example of a step of forming a roller cone.

FIG. 8 illustrates an example of an alternate method of forming the cutting cone 62 described herein. A counter bore 75 is shown formed in the periphery of an inner row of a cutting cone 62. Counter bore 75 was formed during an intermediate stage of forming the cutting cone 62 and prior to heat treatment. Counter bore 75 has the same diameter as compact bore 65 (shown in dashed outline) but a smaller depth. The depth of counter bore 75 is approximately equal to the length of tip 52 (FIG. 3) of compact 50. During heat treatment and carburizing, at least the base of each counter bore 75 is covered by a plug or flat disk so that carburization does not precipitate proximate to where the bores 65 will be formed. After heat treatment, the plug is removed and the bore 65 is formed by drilling into the base of counter bore 75 for the length of barrel 54 (FIG. 3). The total distance from the bottom of bore 65 to the peripheral edge 67 will equal the total height of compact 50. The diameter of bore 65 will be the same as the diameter of counter bore 75.

The scope of the present disclosure is not limited to roller cone bits with flush mounted compacts; but also includes earth boring bits having inserts flush with the bit cutting surface, where the hardness of the inserts exceeds the hardness of the cutting surface material. In an example, the ratio of insert hardness to cutting surface material hardness can range from about 1.2:1 to about 3.3:1. Specific hardness ratios include about 1.2:1, about 1.8:1, about 2:1, about 3:1, and about 3.3:1. These example ratios of hardness are also applicable to the respective material of the compacts 50 and cutting cones 62.

The improvements described herein, therefore, are well adapted to carry out the objects and attain the ends and advantages mentioned, as well as others inherent therein. While presently preferred embodiments have been given for purposes of disclosure, numerous changes exist in the details of procedures for accomplishing the desired results. For example, embodiments exist wherein a row or rows on cutting cones 62, 62A, 62B can include the compacts 50 of FIG. 3 and the compacts 50A of FIG. 3A. Optionally, compacts 50 can be within one row on a cutting cone and compacts 50A on another row of the same cutting cone. These and other similar modifications will readily suggest themselves to those skilled in the art, and are intended to be encompassed within the spirit of the present disclosure and the scope of the appended claims.

We claim:

1. An earth boring bit comprising:

a body;

a leg depending from the body;

a bearing shaft extending inward from the leg;

a cutting cone mounted on the hearing shaft, a cutting disk on the cutting cone; and compacts with the cutting disk that each have an axis oriented relative to an axis of the cutting disk at an angle that differs from an angle between the axis of the cutting disk and an axis of an adjacently located compacts, so that when a row of compacts is set in the cutting disk, the compacts avoid interference between adjacently disposed compacts.

2. The earth boring bit of claim 1, wherein the compacts have crests arranged along a cutting surface defined by a path on the cutting disk surface.

3. The earth boring bit of claim 1, wherein the cutting disk has an upper surface, a lower surface that join each other to define a peripheral edge, and wherein the compacts have crests aligned with the peripheral edge.

4. The earth boring bit of claim 3, wherein the upper and lower surfaces converge towards one another proximate to the peripheral edge and wherein the compacts include flanks depending from the crests, so that when the compacts are disposed in the cutting disk the flanks are flash with the upper and lower surfaces.

5. The earth boring bit of claim 1, wherein the cutting disk is coaxially disposed on the cutting cone.

6. The earth boring bit of claim 1, wherein the compact comprises cemented carbide.

7. The earth boring bit of claim 1, further comprising serrations provided on the cutting disk outer edge between adjacent ones of the compacts.

8. The earth boring bit of claim 7, wherein the serrations have circumferential extents less than a distance between adjacent compacts.

9. The earth boring bit of claim 1, further comprising teeth on the cutting cone having compacts flush within the teeth.

10. The earth boring bit of claim 1, wherein each compact comprises a cylindrically shaped barrel section inserted into a bore in the cutting disk and a chisel shaped tip set flush with an outer surface of the cutting disk and on an axis that is earned at an angle with respect to an axis of the barrel section.

11. The earth boring bit of claim 1, wherein the compact material hardness is at least from about 1.2 to about 3.3 times as hard as the cutting cone material.

* * * * *

UNITED STATES PATENT AND TRADEMARK OFFICE

CERTIFICATE OF CORRECTION

PATENT NO. : 8,307,920 B2
APPLICATION NO. : 12/541048
DATED : November 13, 2012
INVENTOR(S) : Robert J. Buske et al.

It is certified that error appears in the above-identified patent and that said Letters Patent is hereby corrected as shown below:

Column 2, line 59, after "Coupling" delete "be" and insert -- is by --
Column 6, line 66, delete "flash" and insert -- flush --

Signed and Sealed this
Ninth Day of April, 2013

Teresa Stanek Rea
*Acting Director of the United States Patent and Trademark Office*